US012677939B2

(12) United States Patent
Rathbun et al.

(10) Patent No.: US 12,677,939 B2
(45) Date of Patent: Jul. 14, 2026

(54) ROTATING TABLETOP FOR RV/MARINE HAVING TAPERED GEARS

(71) Applicant: ITC Incorporated, Hudsonville, MI (US)

(72) Inventors: Jon Rathbun, Belmont, MI (US); Andrew Fuksa, Fruitport, MI (US)

(73) Assignee: ITC Incorporated, Hudsonville, MI (US)

( * ) Notice: Subject to any disclaimer, the term of this patent is extended or adjusted under 35 U.S.C. 154(b) by 297 days.

(21) Appl. No.: 18/200,288

(22) Filed: May 22, 2023

(65) Prior Publication Data

US 2023/0371685 A1 Nov. 23, 2023

Related U.S. Application Data

(60) Provisional application No. 63/344,866, filed on May 23, 2022.

(51) Int. Cl.
*A47B 13/08* (2006.01)

(52) U.S. Cl.
CPC ..... *A47B 13/081* (2013.01)

(58) Field of Classification Search
CPC ..... A47B 13/081; A47B 5/04; A47B 5/006; B60N 2/24; B60N 3/002; B60N 3/001
See application file for complete search history.

(56) References Cited

U.S. PATENT DOCUMENTS 113,607 A * 4/1871 Wilson ..... A47B 5/04 248/278.1
201,823 A * 3/1878 Oaks ..... A47B 5/04 248/282.1
271,511 A * 1/1883 Pullen ..... A47B 5/04 108/140
3,285,206 A * 11/1966 Hoffman ..... A47B 5/04 108/134
4,852,499 A * 8/1989 Ozols ..... A47B 23/04 108/166
6,179,263 B1 * 1/2001 Rosen ..... B64D 11/00153 248/278.1
6,264,273 B1 * 7/2001 Waters, Sr. ..... B64D 11/0689 297/188.21
6,427,957 B1 * 8/2002 Finneman ..... F16M 11/2064 248/185.1
7,331,418 B2 * 2/2008 Audet ..... B62J 1/12 296/65.09
7,966,949 B2 * 6/2011 Willey ..... B60N 3/002 108/44

(Continued)

FOREIGN PATENT DOCUMENTS

CN 102712278 B * 1/2015 ..... B60N 3/004
CN 113749396 A * 12/2021 ..... A47B 97/00

(Continued)

*Primary Examiner* — Hanh V Tran
(74) *Attorney, Agent, or Firm* — The Dobrusin Law Firm, P.C.

(57) ABSTRACT

A rotating tabletop (such as for RV/Marine use) having tapered gears, wherein the table may be rotated to be 1) stowed; or 2) slightly angled for laptop use. The tapered gear system used in the mechanism allowing the tabletop to rotate to the desired position. A tapered gear is used in the mechanism allowing the tabletop to rotate to the desired position.

3 Claims, 5 Drawing Sheets

(56) References Cited

U.S. PATENT DOCUMENTS

| | | | | |
|---|---|---|---|---|
| 8,297,204 | B1 * | 10/2012 | Giannoccora | A47B 13/081 108/42 |
| 8,556,221 | B2 * | 10/2013 | Kohen | B63B 29/00 296/65.01 |
| 8,616,629 | B2 * | 12/2013 | Jonsson | A47C 7/006 297/171 |
| 8,651,292 | B2 * | 2/2014 | Sunderland | A47B 23/06 439/668 |
| 8,881,659 | B2 * | 11/2014 | Ackeret | B60N 3/004 297/188.2 |
| 9,027,486 | B1 * | 5/2015 | Berkovitz | B60N 3/101 248/458 |
| 9,527,456 | B2 * | 12/2016 | Ackeret | B60R 11/0241 |
| 2011/0309227 | A1 * | 12/2011 | Marshall | B60N 2/01541 248/560 |
| 2016/0107557 | A1 * | 4/2016 | Park | B60N 3/063 296/75 |

FOREIGN PATENT DOCUMENTS

| | | | | | |
|---|---|---|---|---|---|
| CN | 216165964 | U | * | 4/2022 | |
| EP | 3511672 | A1 | * | 7/2019 | G01B 7/16 |
| EP | 2979579 | B1 | * | 3/2021 | A47B 9/04 |
| KR | 102213298 | B1 | * | 2/2021 | A47B 23/06 |
| KR | 20210011465 | A | * | 2/2021 | A47B 23/043 |

* cited by examiner

ROTATING TABLETOP FOR RV/MARINE HAVING TAPERED GEARS

CROSS REFERENCE TO RELATED APPLICATIONS

This application claims priority and benefit to Provisional Patent Application Ser. No. 63/344,866 filed May 23, 2022.

TECHNICAL FIELD

The present specification generally relates tables and, more specifically, a rotating tabletop for use generally in recreational vehicle and marine (or similar) applications.

BACKGROUND

Storable tables in recreational vehicles and marine are well known. RVs usually have different types of tables to suit various purposes. These may include dining tables, coffee tables, foldable or adjustable tables, and outdoor tables for camping setups. These tables take various forms including on hinges, with removable legs . . . etc. so as to optimize space within a small area. These tables are designed with space efficiency in mind. They often feature folding or telescoping mechanisms to allow for easy storage or conversion into different configurations. The size of the tables varies depending on the specific models and floor plan. These tables are usually mounted securely to prevent movement during travel. They may be attached to the floor, walls, or other fixed structures within the vehicle. Stable mounting ensures the table remains steady while the vehicle is in motion. Many tables are designed to serve multiple purposes. For instance, a dining table may have a collapsible design that converts into a bed or an additional workspace. This versatility maximizes the functionality of limited space inside a recreational vehicle or marine. However, these tabletops are traditionally fully horizontal not allowing for rotation where rotation of the tabletop would be helpful for working and/or using a laptop computer, and also storage against a vertical wall.

Accordingly, there exists a need in the art to provide an improved table overcoming the aforementioned disadvantages.

SUMMARY

A rotating tabletop (such as for RV/Marine use) having tapered gears, wherein the table may be rotated to be 1) stowed; or 2) slightly angled for laptop use. The inventive feature being the tapered gear used in the mechanism allowing the tabletop to rotate to the desired position. A tapered gear is used in the mechanism allowing the tabletop to rotate to the desired position.

A rotating tabletop assembly connected to a fixed having a base connected to the fixed surface, a support arm connected to a base, the support arm holding a table, the table configured to rotate when pulled, and a rotating mechanism housed within the support arm, the rotating mechanism having a female gear and a male gear, both the female gear and the male gear being tapered allowing for rotation with minimal displacement, rotating mechanism further comprising a forward bearing block, a rear bearing block, a shaft, and a retaining block, wherein when in use, the forward bearing block, the female gear, and the rear bearing block move when the table is pulled, whereas the male gear, the shaft, the aluminum retaining block remain stationary when the table is pulled thereby disengaging the male gear from the female gear which thereby allows rotation of the table. In some embodiments, the male gear and the female gear must be fully disengaged before rotation. In some embodiments, the male gear and the female gear are tapered so that the male gear and the female gear make full contact when engaged.

A rotating tabletop assembly connected to a fixed surface comprising having a support arm to hold a table, the table configured to rotate when pulled, and a rotating mechanism housed within the support arm, the rotating mechanism having a female gear and a male gear, both the female gear and the male gear being tapered allowing for rotation with minimal displacement, wherein when in use, the female gear moves when the table is pulled, whereas the male gear remains stationary when the table is pulled thereby disengaging the male gear from the female gear which thereby allows rotation of the table. In some embodiments, the male gear and the female gear must be fully disengaged before rotation. In some embodiments, the male gear and the female gear are tapered so that the male gear and the female gear make full contact when engaged. In some embodiments, a base connects to the support arm, the base connected to a fixed surface.

A rotating mechanism for rotating a table top, the rotating mechanism having a female gear and a male gear, both the female gear and the male gear being tapered allowing for rotation with minimal displacement, wherein when in use, the female gear moves when the table is pulled, whereas the male gear remains stationary when the table is pulled thereby disengaging the male gear from the female gear which thereby allows rotation of the table. In some embodiments, the male gear and the female gear must be fully disengaged before rotation. In some embodiments, the male gear and the female gear are tapered so that the male gear and the female gear make full contact when engaged.

BRIEF DESCRIPTION OF THE DRAWINGS

The embodiments set forth in the drawings are illustrative and exemplary in nature and not intended to limit the subject matter. The following detailed description of the illustrative embodiments can be understood when read in conjunction with the following drawings, where like structure is indicated with like reference numerals and in which.

DETAILED DESCRIPTION

The system of the present specification details a rotating tabletop (such as for RV/Marine use) having tapered gears, wherein the table may be rotated to be 1) stowed; or 2) slightly angled for laptop use. The inventive feature being the tapered gear used in the mechanism allowing the tabletop to rotate to the desired position. A tapered gear is used in the mechanism allowing the tabletop to rotate to the desired position. The advantages are discussed herein.

The Rotating Tabletop Assembly 100 generally includes a Base (or vertical leg) 102 mounted to a wall by means of a wall mount 104. It should be appreciated that the Rotating Tabletop Assembly may be attached to any surface (such as a floor) by other means. In this embodiment, the assembly includes a Table (or Table Base) 106 allowing a table surface (not shown) to connect thereto. The Table 106 rotates when pulled (to disengage) such as discussed herein. A Support Arm 108 connects to the Base 102 and is configured to hold the Table 106. The Support Arm 108 also houses the components discussed in the following allowing the Table 106 to rotate. Tables are typically constructed using lightweight and durable materials to optimize space and minimize weight. Common materials include wood, aluminum, or composite materials that offer stability and portability.

The rotating mechanism allowing the Table 106 to rotate broadly includes a Female Gear 114 and a Male Gear 116 where both the Female Gear 114 and the Male Gear 116 are tapered allowing for rotation with minimal movement. It's important to note that this tapering angle is minimal and, in this embodiment, within a range of: 2-15 degrees. Further, the number of teeth on the gears may vary. However, in this embodiment, the teeth range from 10-30 teeth. The rotating mechanism contained in the Support Arm 108 further includes Support Arm 110 which moves along with the following elements: a Forward Bearing Block 112, a female gear 114, a Rear Bearing Block 118. Whereas the following elements remain fixed: a Shaft (and biasing member) 120, an Aluminum Retaining Block 122 and a Support Arm (Axial) 124 (all remains fixed).

Figure 4:
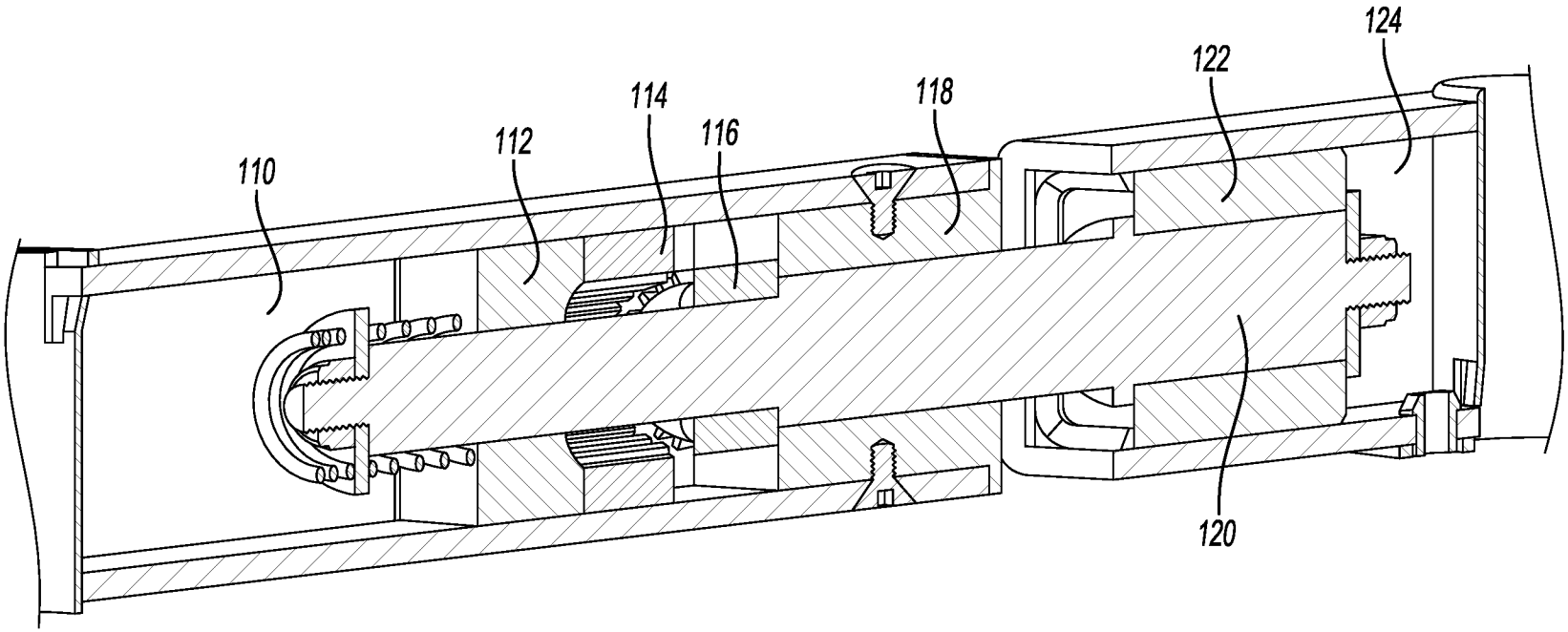
FIG. 4 depicts a perspective and cross-sectional view of the shaft (disengaged) of the rotating tabletop according to one or more embodiments shown and described herein.

When in use, the Forward Bearing Block 112, the Female Gear 114, and the Rear Bearing Block 118 will move (in relation to the wall mount) when the table base is pulled on, while the Male Gear 116, the Shaft 120, the Aluminum Retaining Block 122 and will remain stationary. This movement disengages the Male Gear 116 from the Female Gear 114 which thereby allows rotation. FIG. 4 illustrates the rotation mechanism disengaged. The Table 106 is then rotated to the desired position and allowed to travel back into place, re-engaging the gear mechanism at the new location in increments of 15 degrees.

Figure 1:
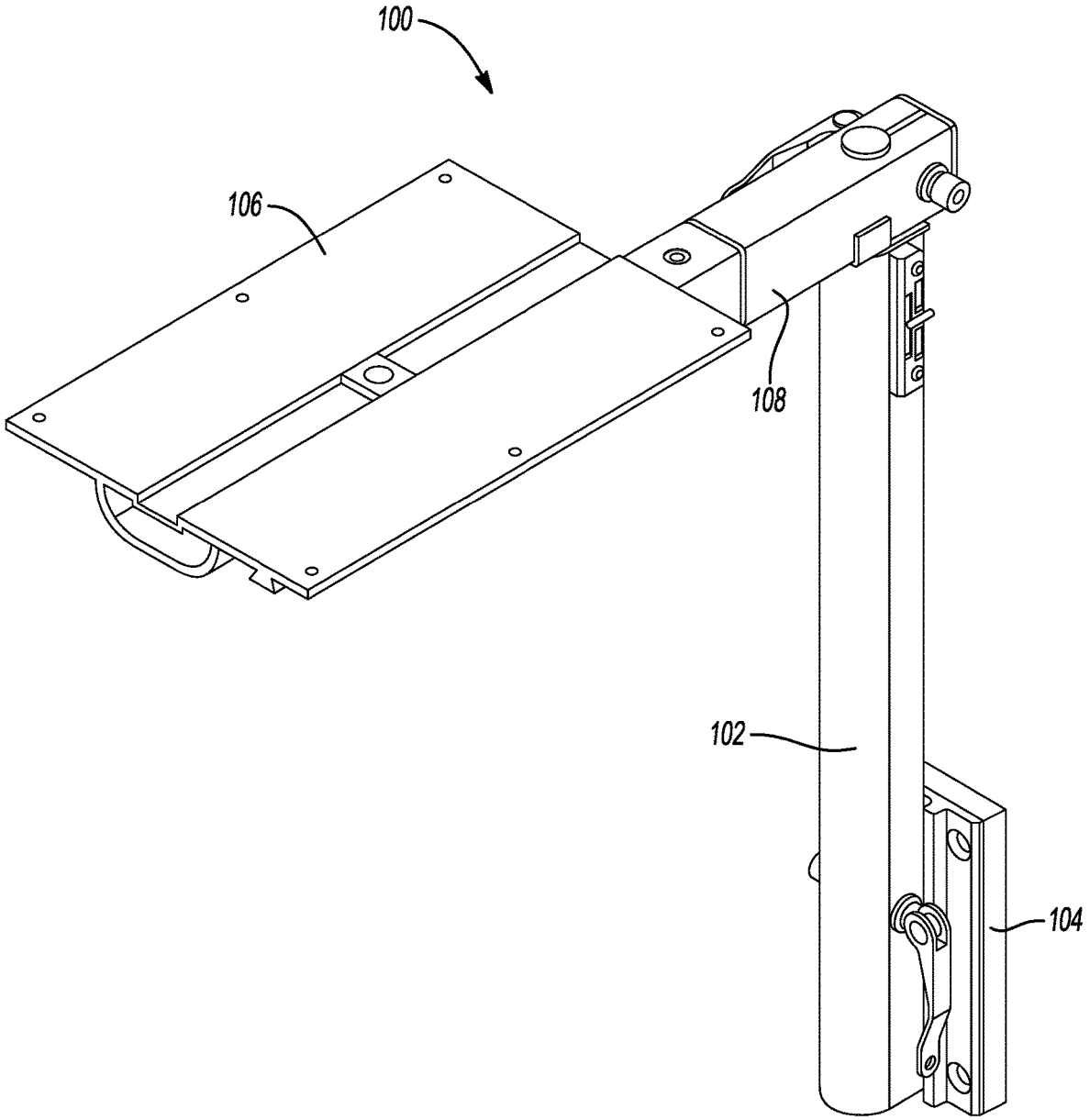
FIG. 1 depicts a perspective view of the rotating tabletop according to one or more embodiments shown and described herein.
Figure 2:
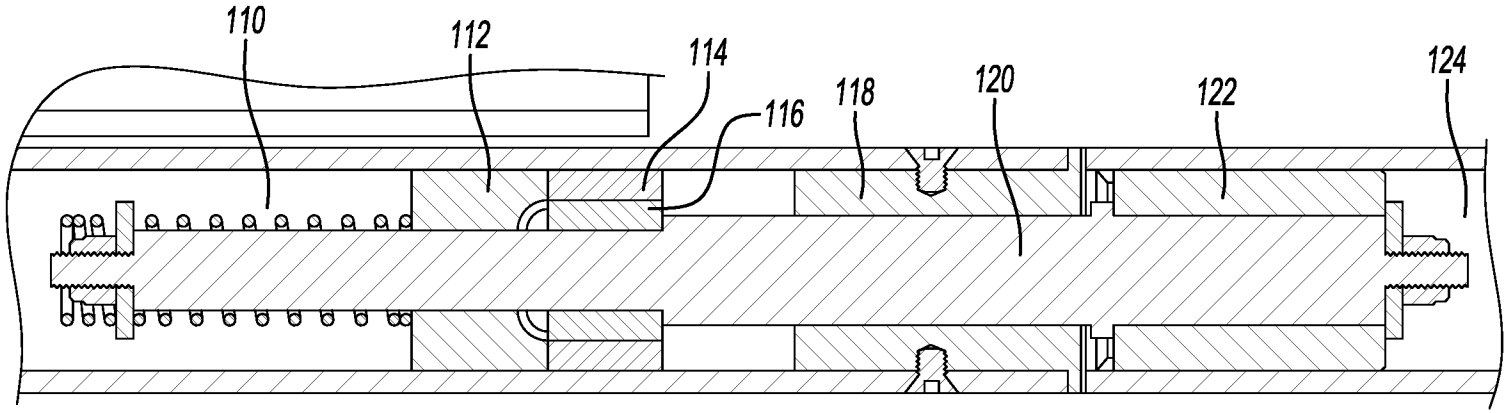
FIG. 2 depicts a cross-sectional view of the shaft of the rotating tabletop according to one or more embodiments shown and described herein.
Figure 3:
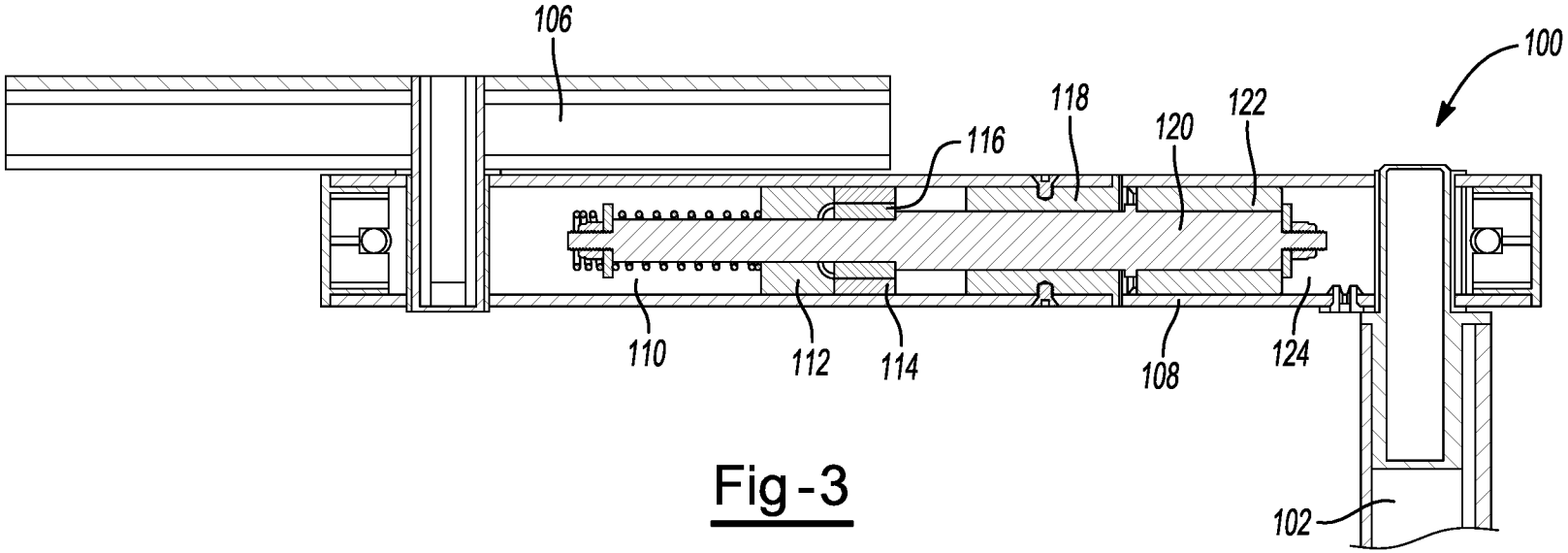
FIG. 3 depicts a cross-sectional view of the shaft connected to the support beam of the rotating tabletop according to one or more embodiments shown and described herein.

FIGS. 2 and 3 generally illustrate the rotation mechanism in an engaged position. In this position, the Female Gear 114 and the Male Gear 116 are both tapered (slightly) and connected.

Figure 5:
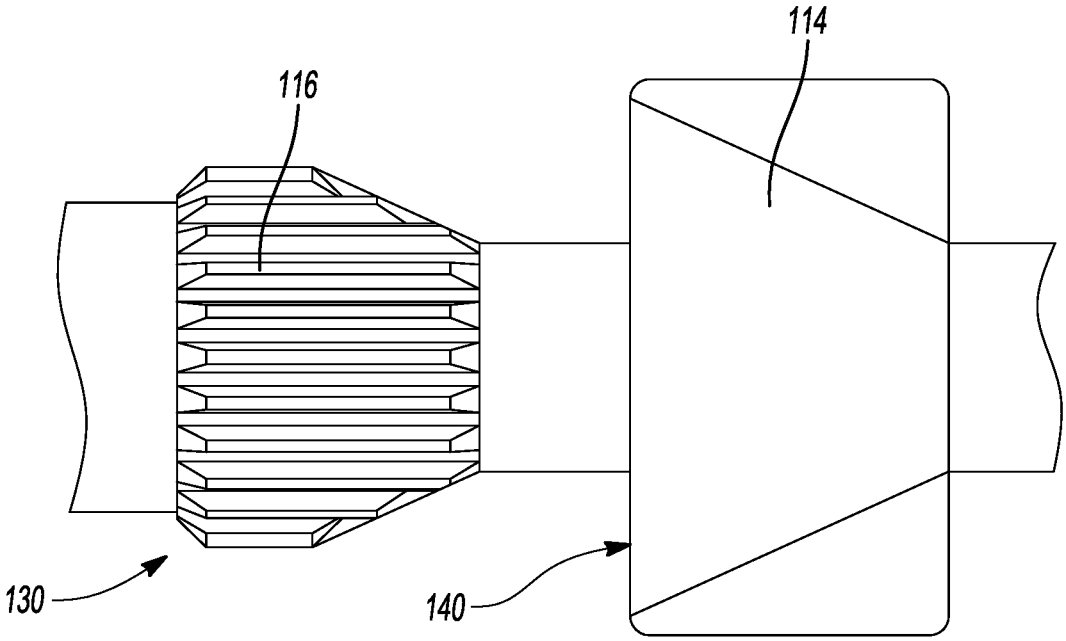
FIG. 5 depicts a side view of the gear (fully disengaged) of the rotating tabletop according to one or more embodiments shown and described herein.

FIG. 4 illustrates the rotating mechanism in the disengaged position where the Male Gear 116 is separated from the Female Gear 114. A close-up view of this disengagement is illustrated in FIG. 5 (note that the tapering is as indicated by the angled lines on both the Female Gear 114 and the Male Gear 116).

Figure 6:
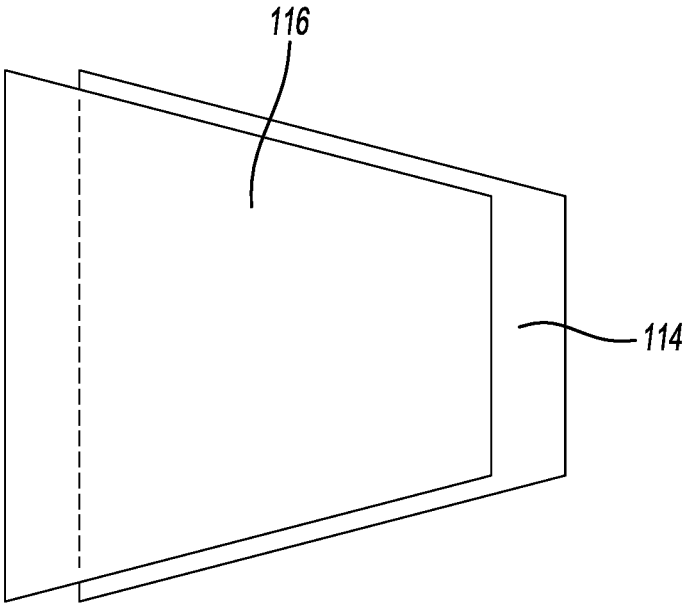
FIG. 6 depicts a side view of the gear (just barely disengaged) of the rotating tabletop according to one or more embodiments shown and described herein.
Figure 7:
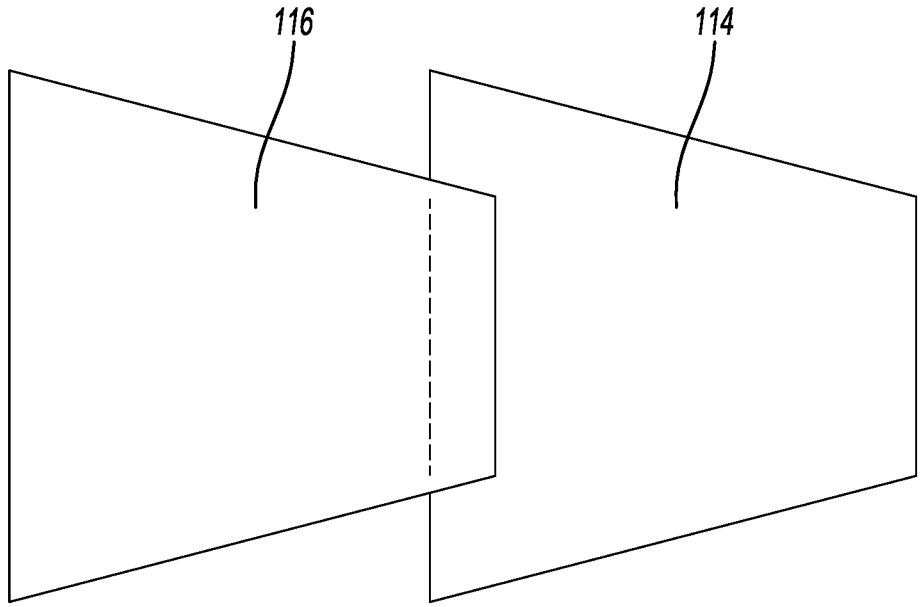
FIG. 7 depicts a side view of the gear (fully disengaged) of the rotating tabletop according to one or more embodiments shown and described herein.
Figure 8:
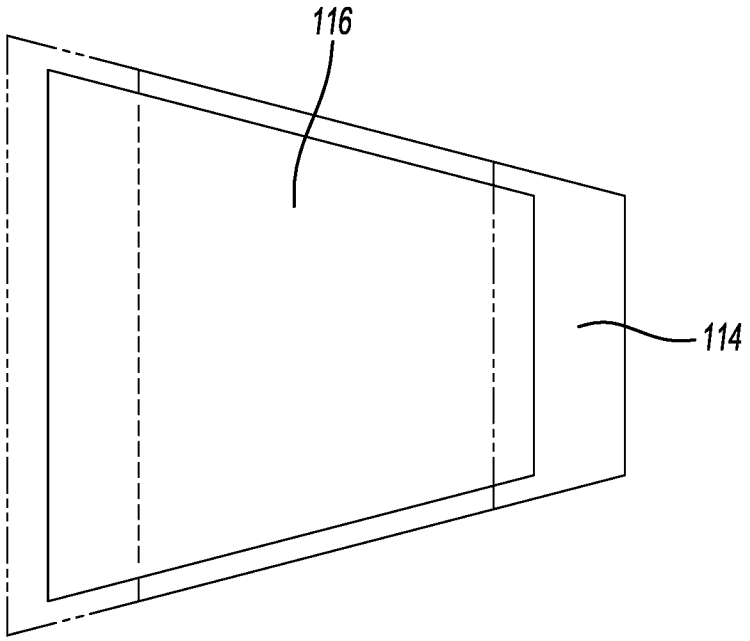
FIG. 8 depicts a side view of the gear (engaged) of the rotating tabletop according to one or more embodiments shown and described herein.

FIG. 6 indicates the instance of the immediate break of engagement between the Female Gear 114 and the Male Gear 116. This configuration is advantageous in that full removal of the Male Gear 116 from the Female Gear 114 is not required to enable rotation of the Table. In the present embodiment, the gears must be fully disengaged before rotation is possible as the gears interfere with one another until fully separated.

Both the male and female gear pieces are tapered such that they make full contact when engaged. Advantages of the tapered gear system as shown and described herein include: 1) the structure provides a natural lead in when trying to re-engage the gears at the new position; you do not need exact alignment to get them back together. 2) with the taper, the engagement between the surfaces is immediately broken when pulling back on the table; if the engagement was not tapered, there would be friction between the 2 parts the entire length while pulling back on the table, and 3) The arrangement reduces the likelihood of gear backlash due to tolerancing. With the taper, if tolerance are off slightly it is accounted for by the gears engaging slightly sooner or later. If the gears were straight, then any tolerance would either cause them not to fit together or have slop that can be felt in the tabletop.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

It is noted that the terms "substantially" and "about" may be utilized herein to represent the inherent degree of uncertainty that may be attributed to any quantitative comparison, value, measurement, or other representation.

These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter.

Unless otherwise stated, any numerical values recited herein include all values from the lower value to the upper value in increments of one unit provided that there is a separation of at least 2 units between any lower value and any higher value. As an example, if it is stated that the amount of a component, a property, or a value of a process variable such as, for example, temperature, pressure, time and the like is, for example, from 1 to 90, preferably from 20 to 80, more preferably from 30 to 70, it is intended that intermediate range values such as (for example, 15 to 85, 22 to 68, 43 to 51, 30 to 32 etc.) are within the teachings of this specification. Likewise, individual intermediate values are also within the present teachings. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the Invention of a range in terms of at "x' parts by weight of the resulting polymeric blend composition" also contemplates a teaching of ranges of same recited amount of "x" in percent by weight of the resulting polymeric blend composition."

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of, or even consist of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps. All references herein to elements or metals belonging to a certain Group refer to the Periodic Table of the Elements published and copyrighted by CRC Press, Inc., 1989. Any reference to the Group or Groups shall be to the Group or Groups as reflected in this Periodic Table of the Elements using the IUPAC system for numbering groups.

While particular embodiments have been illustrated and described herein, it should be understood that various other changes and modifications may be made without departing from the spirit and scope of the claimed subject matter.

Moreover, although various aspects of the claimed subject matter have been described herein, such aspects need not be utilized in combination.

It is therefore intended that the appended claims (and/or any future claims filed in any Utility application) cover all such changes and modifications that are within the scope of the claimed subject matter.

Moreover, although various aspects of the claimed subject matter have been described herein, such aspects need not be utilized in combination.

It is therefore intended that the appended claims cover all such changes and modifications that are within the scope of the claimed subject matter.

Element List:

| | |
|---|---|
| 100 | Rotating Tabletop Assembly |
| 102 | Base |
| 104 | Wall Connection |
| 106 | Table (or Table Base) |
| 108 | Support Arm |
| 110 | Support Arm Interior Distal |
| 112 | Forward Bearing Block |
| 114 | Female Gear |
| 116 | Male Gear |
| 118 | Rear Bearing Block |
| 120 | Shaft |
| 122 | Aluminum Retaining Block |
| 124 | Support Arm Interior Axial |

The invention claimed is:

1. A rotating tabletop assembly connected to a fixed surface comprising:

a base connected to the fixed surface;

a support arm connected to a base, the support arm having a longitudinal length and a rotational axis, the support arm holding a table, the table configured to rotate when pulled; and a rotating mechanism housed within the support arm, the rotating mechanism having a female gear and a male gear, both the female gear and the male gear having a plurality of teeth and being tapered allowing for rotation with minimal displacement, the rotating mechanism further comprising a forward bearing block, a rear bearing block, a shaft, and a retaining block;

wherein when in use, the forward bearing block, the female gear, and the rear bearing block move along the longitudinal length of the support arm when the table is pulled, whereas the male gear, the shaft, and the retaining block remain stationary when the table is pulled thereby disengaging the male gear teeth from the female gear teeth which thereby allows rotation of the table.

2. The rotating tabletop assembly of claim 1 wherein the male gear and the female gear must be fully disengaged before rotation.

3. The rotating tabletop assembly of claim 1 wherein the male gear and the female gear are tapered so that the male gear and the female gear make full contact when engaged.

* * * * *